United States Patent [19]

Dietz et al.

[11] 4,098,050

[45] Jul. 4, 1978

[54] METHOD OF STAGGER PACK PARTITIONLESS PACKAGING

[75] Inventors: Max R. Dietz; Cameron D. Keim; Lloyd A. Nelson, all of Fremont, Mich.

[73] Assignee: Gerber Products Company, Fremont, Mich.

[21] Appl. No.: 538,285

[22] Filed: Jan. 2, 1975

Related U.S. Application Data

[63] Continuation of Ser. No. 153,854, Jun. 16, 1971, abandoned, which is a continuation of Ser. No. 754,437, Aug. 21, 1968, abandoned.

[51] Int. Cl.[2] ..... B65B 11/00; B65B 21/00

[52] U.S. Cl. ..... 53/26; 53/32

[58] Field of Search ..... 53/26, 32, 207, 209, 53/159, 230, 374

[56] References Cited

U.S. PATENT DOCUMENTS

| | | | |
|---|---|---|---|
| 2,535,880 | 12/1950 | Tomkins | 53/26 |
| 2,931,153 | 4/1960 | Daniels | 53/374 |
| 2,955,707 | 10/1960 | Foote | 206/427 |
| 3,073,086 | 1/1963 | Martin et al. | 53/26 X |
| 3,332,207 | 7/1967 | Midnight | 53/207 |

*Primary Examiner*—Robert L. Spruill

*Attorney, Agent, or Firm*—Townsend and Townsend

[57] ABSTRACT

A method for packaging glass jars by arranging the jars in nested engagement in staggered rows in a wrap-around fiberboard carton. By utilizing corrugated fiberboard with the corrugations extending at an angle to the score lines formed in the carton blank, consistency of carton dimensions is insured. The use of a film-type overwrap shrunken onto each jar minimizes any adverse effect caused by breakage and provides a surface for imprintation.

3 Claims, 3 Drawing Figures

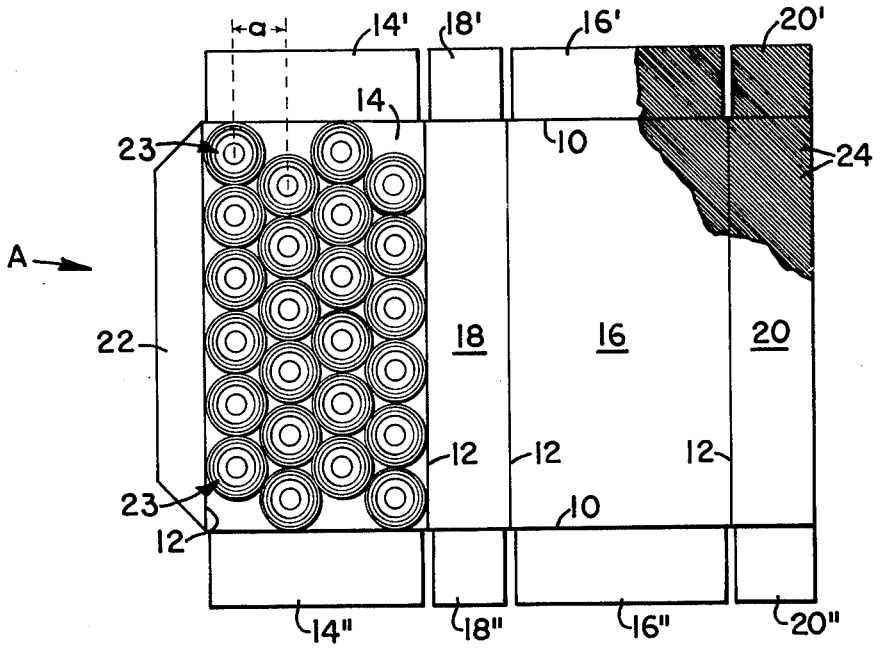
FIG_1
FIG_2
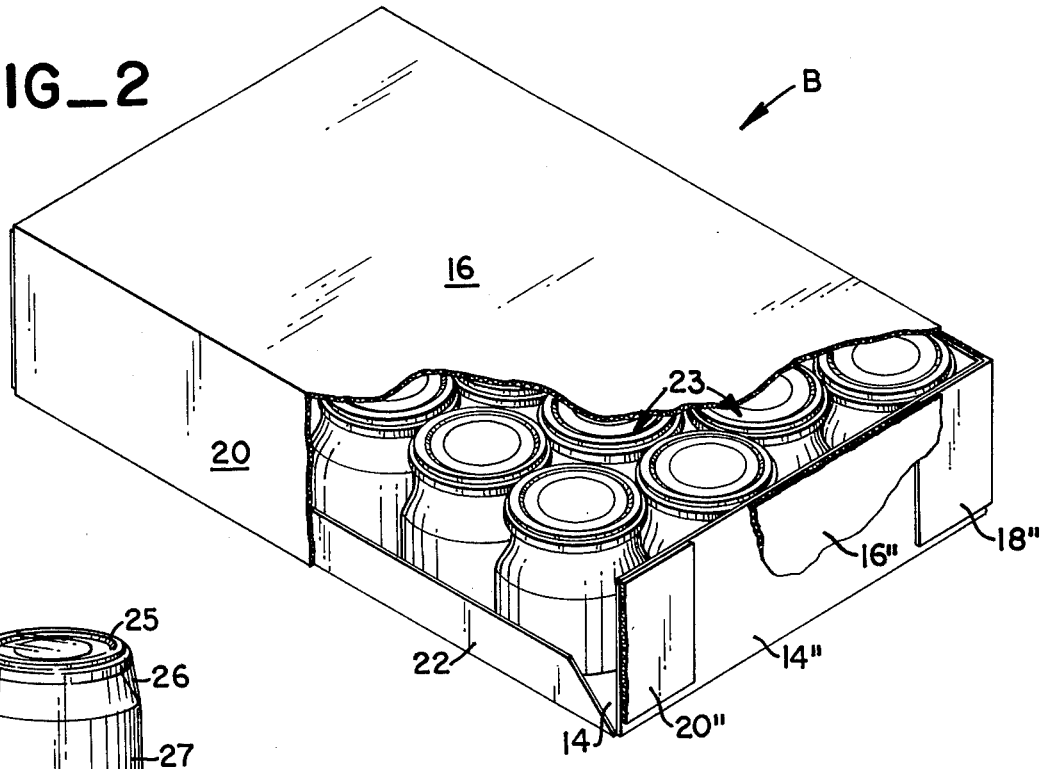
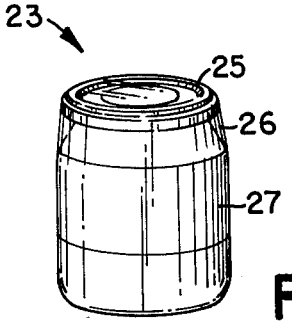
FIG_3

METHOD OF STAGGER PACK PARTITIONLESS PACKAGING

This is a continuation of application Ser. No. 153,854, filed June 16, 1971 now abandoned which is a continuation of application Ser. No. 754,437, filed Aug. 21, 1968 now abandoned.

This invention relates to the packaging of filled glass jars and, more particularly, to a wrap-around partitionless carton containing jars arranged in nested relationship, and to the method for accomplishing such packaging.

Presently glass jars such as employed in the baby food industry are packaged for shipping and/or storage in top-opening cartons. The jars are usually loosely arranged in an "on-diameter" configuration with cardboard partitions between adjacent jars. In this manner, the partitions protect the individual jars from the force of unintentional impacts, thereby insuring a minimum of breakage. However, with this type of packaging the resulting cartons must, of necessity, be bulky. For this reason, excessive amounts of storage and/or shipping facilities are required. In addition, large amounts of paperboard are necessary to fabricate the carton and the partitions.

It has now been found that glass jars can be packaged in partitionless cartons without significantly increasing jar breakage provided that the jars are arranged in rows that are of nested (staggered) configuration. It is especially preferable for the carton to have end or side closures, i.e., to be end-opening as opposed to conventional top-opening to provide additional protection for the jars. For convenience in the following discussion of the invention, this type of carton configuration will hereinafter be referred to as being of "wrap-around" construction.

A staggered configuration has heretofore been employed in the storage and shipment of comestibles packaged in metallic containers, eg., tin cans. However, similar packaging arrangements are not known to have been previously utilized for glass jars. Those skilled in the art have been of the opinion that partitionless arrangements would result in a prohibitively high jar breakage ratio. Contrary to this assumption, it has now been found that elimination of the partitions does not significantly increase the likelihood of breakage. In fact, under similar conditions, it has been demonstrated that superior resistance to crushing forces is provided when jars are packed in four nested rows each containing six jars, as compared with conventional partitioned packaging in a similar $4 \times 6$ configuration.

For purposes of illustration only, the remainder of the specification will be directed to the packaging of 24 substantially identical glass baby food jars, such as 5-ounce or $3\frac{1}{2}$ ounce jars, in four nested rows of six jars each and enclosed within an end-opening, wrap-around carton. However, it will be understood by one skilled in this art that other quantities of jars as well as other staggered (nested) arrangements can be employed. Furthermore, it is also intended that the term "end-opening" include "side-opening", but be contrasted with top-opening cartons.

In another aspect, the wrap-around carton is formed so that the nested jars are retained in constant physical contact with each other. In addition, the arrangement is such that the peripheral jars contact respective portions of the side and end walls of the carton, while the tops and bottoms of the jars contact the top and bottom panels of the carton when the paperboard blank is wrapped around the nested jars. It will be understood by those skilled in this art that "constant physical contact" is intended to include a looseness of up to about 1/32 inch in length and/or width. Under such conditions, it is difficult, if not impossible, for the individual glass jars to be propelled (or accelerated, or in any manner moved) into impact with adjacent jars in the wrap-around carton. Thus, a unitary package is produced.

To insure the continuous retention of this arrangement of jars, it has been found to be advantageous to employ corrugated paperboard in which the corrugations are arranged at an angle to the score lines in the carton blank so that the score lines are formed across the corrugation rather than in the ridges and grooves thereof. In this way, folding the blank along the score lines will produce a carton having the dimensions intended. When the score lines are parallel with the ridges and grooves in the corrugations, variations in the actual dimensions of the carton can result.

In still another aspect, the use of a transparent film overwrap to provide a separate cocoon-type enclosure for each glass jar has been found to be especially advantageous. Although the seal between the jar cap and the jar itself is more than adequate to maintain an aseptic condition within the jar, occasionally, if a jar should accidently be broken or damaged during shipping or storage, food particles may find their way into the crevice between the cap and jar. Under such conditions, it is presently necessary to destroy such jars as they are obviously unsaleable. However, the use of a plastic overwrap formed from a conventional material such as a heat-shrunken film or polyvinyl chloride, polyethylene, or the like, has been found to prevent the spread of contamination or infestation, should a jar accidently be broken or damaged during storage or shipping. This type of skin-like overwrap is more effective than the cardboard partitions currently utilized because any product dispersion resulting from such accidental discharge will usually be confined to a small area or even within the cocoon of the damaged jar. More specifically, even when the film extends only across the opening between the cap rim and the glass portion of the jar, food particles or other matter are prevented from becoming lodged in this crevice. The cocoon-like overwrap has the additional advantage of being a receptive surface for label imprinting, thus eliminating the need for a separate paper label.

The objects, features and advantages of this invention will become more apparent when reference is made to the following detailed disclosure, especially in view of the attached drawing, wherein:

FIG. 1 is a top plan view of the jars arranged in accordance with this invention and positioned on a carton blank;

FIG. 2 is a partially cutaway perspective view illustrating the arrangement of the jars in the finished carton; and FIG. 3 is a perspective view of a glass jar with a skinlike plastic overwrap.

Referring more particularly to the drawing, wherein similar characters of reference represent corresponding parts in each of the several views, in FIG. 1 there is shown a carton blank A that has formed from a flat sheet of flexible corrugated material in a conventional manner such as with rotary blank-forming (or die-cut forming) paperboard manufacturing equipment. Blank A includes a number of longitudinal score lines 10 and a number of transverse score lines 12. The score lines are arranged to form bottom panel 14, top panel 16 and side panels 18 and 20. Flaps 14', 14'', 16', 16'', 18', 18'' 20' and 20'' are attached to respective of panels 14, 16, 18 and 20. Flap 22 is provided in hinged attachment to bottom panel 14 for producing the conventional manufacturer's joint or seal.

Twenty-four glass jars 23 are arranged in four rows of six jars each. The rows of jars 23 are offset by a distance equivalent to one-half the jar diameter and are nested so that the distance *a* between respective planes formed by the axes of the jars in adjacent rows is less than the diameter of jars 23. More particularly, distance *a* equals the diameter of one jar 23 times the cosine of 30°, or 0.866 × diameter of jar.

Although it is not intended that the invention be limited by any theoretical concept, it appears that the stagger-pack or nested glass jar packaging arrangement provides impact resistance comparable to on-diameter partitioned packaging as a direct result of the increase in the number of jar-to-jar contacts throughout the carton. In this manner, any impact load is distributed to a greater number of jars in the case. Furthermore, the dispersion of impact forces occurs diagonally rather than in a straight line as in on-diameter packaging. Thus the force transmitted from one jar to another is only a component of the initial impact rather than the total impact. For example, when 24 glass jars are packed "on-diameter" in four rows of six jars, a total of 38 end and side jar-to-jar contact points are created. In contrast, four staggered rows of six jars each provide a total of 53 end and side jar-to-jar contact points, each internally-positioned jar physically contacting six adjacent jars, two in the same row and two in each adjacent row. In contrast, "on-diameter" packaging results in only four such contact points.

In assembling blank A into the intended carton configuration B, it will be apparent to one skilled in this art that any conventional method can be employed, such as gluing and the like. Although the sequence of flap folding is not critical, it has been found to be advantageous to first position a long flap such as flap 14' over the end or side opening. Then both of the short flaps 18 and 20' are inserted over and secured to flap 14' such as by gluing. Finally, long flap 16' is then disposed over flaps 18' and 20' and held in place in a conventional manner. This end flap (or side flap) arrangement has been found to produce additional protection in the form of an impact cushion for the glass jars and substantially reduce jar breakage or damage.

As previously set forth, blank A is formed so that corrugations 24 in the paperboard material from which blank A is fabricated are arranged at an angle to all the score lines 10 and 12. By providing blank A cut so that the corrugations extend at about a 45° angle to all score lines, optimum results are provided. Thus when blank A is folded into the rectangular carton depicted in FIG. 2, the desired dimension of the box will be maintained consistent. This is to be contrasted with carton blanks of the prior art wherein the corrugations are perpendicular to one set of score lines and parallel to others so that the actual dimensions of the carton may vary slightly in its inner dimensions depending on whether the score lines extend along a groove or on a ridge of the corrugated material.

Turning now to FIG. 3, there is shown a single jar 23, including cap 25, and having a skin-like overwrap (cocoon) 26 of a polyvinyl chloride film originally being capable of shrinking from 10–15% along its width. Overwrap 26 was formed by enveloping jar 23 with the film and applying heat to the film to shrink it along its width. Label 27 was imprinted directly upon overwrap 26. Conventional scanning equipment is utilized to properly align labels on successive of jars 23 in an assembly-line type of operation.

Although it is preferable to have the transparent overwrap 26 completely enclose jar 23, it will be understood by one skilled in this art that the plastic overwrap can be confined to the label area and/or immediately adjacent the crevice between lid 25 and jar 23.

Although the foregoing invention has been described in some detail by way of illustration for purposes of clarity of understanding, it will be apparent to one skilled in this art that certain changes and modifications may be practiced within the spirit of this invention as limited only by the scope of the appended claims.

What is claimed is:

1. In a method for packaging a plurality of generally cylindrically-shaped glass jars at least partially enclosed in a corrugated paperboard carton, so as to minimize breakage of said jars from impact, the steps comprising: moving said carton relative to and about said plurality of glass jars arranged in parallel rows, wherein the distance between horizontal center lines of adjacent parallel rows of jars in said carton is less than the diameter of each of said jars with the proviso that one end of said row of jars is spaced from said carton by a distance corresponding to at least about one-half the diameter of said jar; and forming the carton so as to hold said jars in constant physical contact with each other to prevent displacement of the jars relative to the carton, the peripheral jars being in constant physical contact with the carton.

2. A method in accordance with claim 1, and further characterized by employing an end-opening carton that is formed by folding a corrugated paperboard carton blank along pre-formed fold lines so that the peripheral jars will be in constant physical contact with respective portions of the side and end walls of the carton.

3. A method in accordance with claim 2, wherein said end-opening carton is formed so as to have the two internal end flaps across the entire end of the carton disposed on opposite sides of two flaps extending a distance equal to about the height of the carton.

* * * * *